United States Patent [19]

Vahl et al.

[11] 4,258,865

[45] Mar. 31, 1981

[54] DISPENSER FOR LIQUID OR PASTY SUBSTANCES SUCH AS LIQUID SOAP AND THE LIKE

[76] Inventors: Joachim Vahl, Gansenbergweg 60, 4224 Hünxe, Fed. Rep. of Germany; Alfred Tiefenthal, Kastellstr. 4, 4132 Baerl, Fed. Rep. of Germany

[21] Appl. No.: 969,565

[22] Filed: Dec. 11, 1978

[30] Foreign Application Priority Data

Dec. 10, 1977 [DE] Fed. Rep. of Germany ..... 2755112

[51] Int. Cl.[3] ..... B05B 9/04

[52] U.S. Cl. ..... 222/213; 222/214

[58] Field of Search ..... 222/103, 214, 181, 490, 222/96, 212, 105, 213

[56] References Cited

U.S. PATENT DOCUMENTS 3,926,347 12/1975 Low et al. ..... 222/214 X 4,098,434 7/1978 Uhlig ..... 222/212 X

*Primary Examiner*—Stanley H. Tollberg

*Attorney, Agent, or Firm*—Michael J. Striker

[57] ABSTRACT

The dispensing device for liquid soap includes a rigid housing adapted for accommodating a container having a downwardly directed discharge tubing of resilient material and a rear wall portion of the container is shaped into the form of frustoconical outwardly projecting bellows. A lever mechanism including an upright compressing lever, a horizontal sliding lever and a downwardly projecting trip lever is arranged in the housing for movement between a closing position in which the sliding lever clamps the discharge tubing, and a discharging position in which the compressing arm exerts pressure against the bellows and the sliding arm is spaced apart from the tubing to allow the discharging of the contents of the container.

6 Claims, 10 Drawing Figures

DISPENSER FOR LIQUID OR PASTY SUBSTANCES SUCH AS LIQUID SOAP AND THE LIKE

BACKGROUND OF THE INVENTION

This invention relates generally to dispensing devices for discharging in discrete portions liquid or pasty substances, such as liquid or pasty soap or other toilet articles.

German publication No. 25 09 804 describes a dispenser of the above type in which a compressible container for the liquid or pasty substance to be discharged is subject to pressure from a hand-operated lever whereby the substance is discharged through a downwardly directed discharge conduit. The container is arranged in a rigid housing and the lever is operable so that it compresses the container and opens the discharge conduit simultaneously, and likewise simultaneously relieves the pressure from the container and closes the discharge conduit. The disadvantage of this arrangement is that a comparatively large force is required especially during the end phase of the discharging process, so that the container can be emptied only with difficulties.

SUMMARY OF THE INVENTION

It is, therefore, an object of the invention to overcome the aforementioned disadvantage.

More particularly, it is an object of the invention to provide an improved dispenser of the above-described type which is simpler and more convenient in operation.

Another object of the invention is to provide such an improved dispenser which allows its contents to be completely discharged.

Still another object of this invention is to provide such an improved dispenser which requires a relatively small force for operation and dispenses a substantially larger volume of its contents than prior-art dispensers of this type.

A further object of the invention is to provide an improved dispenser which facilitates replacement of used containers in the rigid dispenser housing.

In keeping with these objects, and others which will become apparent hereafter, one feature of the invention resides, in a dispensing device for liquid or pasty substances such as soap and the like toilet articles, in a combination which includes a rigid housing and, within the housing, a container having at least one portion thereof in the form of a resilient outwardly projecting bellows and including a downwardly directed discharge passage, and a two-arm lever mechanism movable in the housing between a closed position in which one arm closes the passage and a dispensing position in which the one arm opens the passage and the other arm compresses the bellows.

By making part of the container in the form of a bellows, a relatively small force is required for compressing the container. Moreover, a relatively large volume of the container is compressible, and the bellows, because of its resiliency, returns to its original shape after pressure on it has been relieved.

This invention has the advantage that as long as the container is initially fully charged, the pressure from the user operated lever is transferred, via the walls of the container, directly to its contents. As soon as the container is partially emptied, the compression of the bellows causes a strong increase of the air pressure inside the container so that the resulting pressurization quickly forces a portion of the liquid or pasty soap out of the discharge passage. Thus the increased air pressure in the container allows complete emptying of its contents.

In a particularly advantageous embodiment of this invention, the bellows is formed on a rear wall portion of the container (when the container is considered in its working position in the housing) and the compressing arm of the lever mechanism projects vertically in the rear part of the housing to abut against the bellows substantially in a vertical plane. This arrangement simplifies the entire structure because upon relieving the pull on the compressing arm of the lever mechanism, the bellows, because of its resiliency, returns to its original extended condition and thus displaces the lever mechanism into its starting position. Preferably, the bellows has three or four folds or pleats which in the working position of the container are in parallel vertical planes.

In a further modification of the container of this invention the side thereof opposite the bellows has at its upper range two lateral depressions defining therebetween an upwardly directed bridge portion forming a handle. Preferably, the handle is shaped of two opposite side wall portions each having an inwardly depressed center area so that the handle defines bulging edges which are convenient hand grips.

In a further modification, the discharge passage of the container is in the form of an outwardly projecting coupling nipple or stub preferably provided with external threads for a closure cap and for screw connection of an extension hose when the container is installed.

According to another feature of this invention, the container is placed in a prismatic housing assembled of two complementary parts, each of the housing parts having common lateral walls and a common top wall, whereby the lower front edge of the rear part of the housing is provided with hinges for tiltably connecting the front housing part to the rear housing part. The interior of the housing and especially the hinged front part thereof has a contour which matches the outer contour of the storage container so that the inner walls of the housing snugly fit the outer walls of the container.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
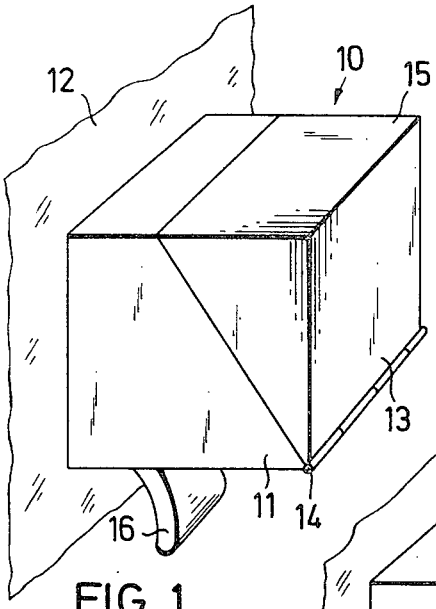
FIG. 1 is a perspective view of the dispensing device of this invention.
Figure 2:
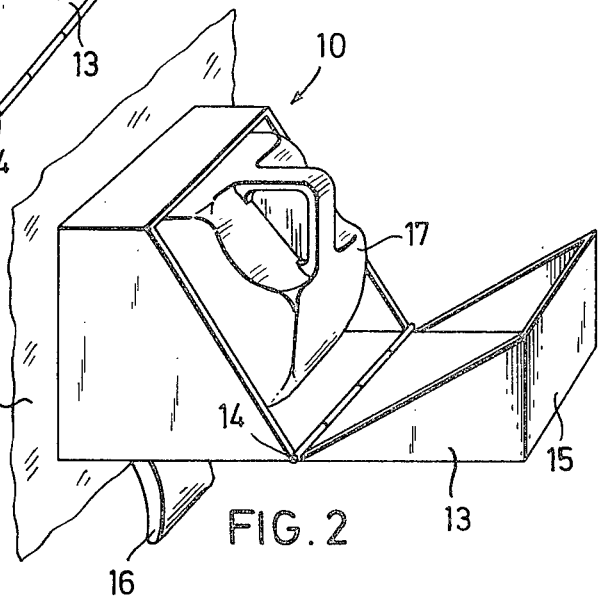
FIG. 2 is the device of FIG. 1 shown with the front part of its housing in an open position.

The liquid soap dispensing device 10 according to this invention consists of a prismatic housing 11 adapted for being fixed on a wall 12. In this embodiment, housing 11 is assembled of two complementary parts, the front part 13 being rotatable about a horizontal hinge 14 extending along the lower front edge of the rear part of the housing. The open position of the front part 13 of housing 11 is illustrated in FIG. 2. In the closed position of housing 11, front part 13 complements horizontally directed top wall 15 and both lateral walls of the housing. The bottom wall of the housing is provided with an opening through which projects a hand-operated trip portion 16 of a two-arm lever mechanism as will be explained below. As seen in FIG. 2, the housing accommodates container 17 of a compressible elastic material for storing a liquid or a pasty substance such as liquid soap and the like. The container 17 has at its bottom a downwardly projecting discharge tube 18 of elastic material. In accordance with this invention, the rear wall of container 17 is in the form of an outwardly projecting bellows 19 formed of a plurality of folds or pleats 17*a*–17*c*. Bellows 19 has a substantially frustoconical configuration. The outermost circular fold 17*a* has the smallest diameter and the last circular fold 17*c* joining the container 17 has the largest diameter so that, upon compression of bellows 19 the folds 17*a*–17*c* are displaced one into the other in a telescopic fashion. By virtue of this tapering configuration of bellows 19 the inner volume of container 17 may be considerably reduced.

The operation of the dispenser is explained with reference to FIGS. 3 and 4. Container 17 initially fully filled with soap, is first inserted into housing 11. In this position, the rear part of the bottom wall of container 17 and of discharge tubing 18 comes into abutment with a stationary stop member 22 projecting from the bottom of the housing and matching the contour of the adjoining container parts. The opposite side of discharge tubing 18 is squeezed by a movable projection 21 mounted on one end of a horizontally elongated sliding arm 20 which at its other end is connected to a vertically elongated compressing arm 23 and to downwardly projecting hand-operated trip element 16. During the insertion of container 17 trip element 16 is moved in its slot in the bottom of housing 11 to the right as indicated in FIG. 4 so that slider 20 with squeezing projection 21 is spaced apart from the stationary projection 22 and discharge tubing 18 of the container can be inserted into the open passage between projections 21 and 22. Thereupon trip lever 16 is released and moved to the left (FIG. 3) and the hinged part 13 of housing 11 is closed. Preferably, the lever mechanism 16, 20 and 23 is urged into its rest position by means of spiral spring 30 (FIG. 5) and the projection 21 firmly squeezes the pliable discharge tubing 18 which projects through a corresponding opening in the bottom of housing 11. Prior to use, the projecting end of discharge tubing 18 is sealed. Since in the closed position of the dispenser as illustrated in FIG. 3, any discharge of the liquid from container 17 is effectively prevented by the clamping action of projections 21 and 22, tubing 18 can be opened by cutting off the sealed end portion with a knife or scissors.

To dispense an individual portion of liquid soap from container 17, trip lever 16 is moved manually in forward direction (to the right in FIG. 3 and against the force of spring 30 in FIG. 5), causing the upright compression lever 23 to compress frustoconical bellows 19. Simultaneously, clamping projection 21 is shifted by slider 20 forwardly away from the stationary abutment projection 22 so that discharge tubing 18 opens by its own elasticity. Pressure exerted on bellows 19 by arm 23 causes discharge of liquid from the container and the discharge takes place as long as trip lever 16 continues moving forwardly. When container 17 is initially fully filled with a soap, pressure exerted by upright arm 23 is transmitted directly to the soap. If container 17 is only partially filled up with soap pressure from bellows 19 is first transmitted to the air above the liquid level and then to the liquid so that the discharge of the latter through tubing 18 is always insured. As soon as the forward movement of trip lever 16 is discontinued, no additional pressure builds up in the interior of container 17 and the liquid discharge is stopped. On releasing trip lever 16 bellows 19 due to its own elasticity starts reverting to its initial shape and urges upright arm 23 to its closed position as is indicated in FIG. 3. At the same time, clamping projection 21 recompresses elastic discharge tubing 18 against the stationary abutment projection 22 and container 17 is closed. The embodiment of this invention illustrated in FIGS. 3 and 4 enables liquid soap to be dispensed in predetermined portions controlled by the length of time trip lever 16 is pulled forwardly, during which movable clamping projection 21 disengages the discharge tubing 18 and opens the discharging passage.

Figure 3:
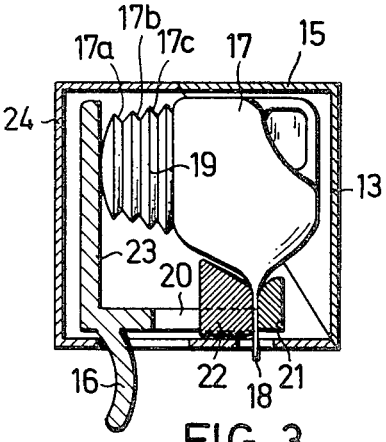
FIG. 3 is a sectional side view of the dispenser of FIG. 1 in its prior to operation position.
Figure 4:
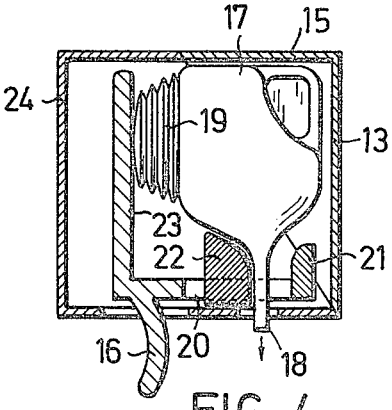
FIG. 4 is a device of FIG. 3 shown in operation.

In the embodiment of FIGS. 3 and 4 lever mechanism 16, 20 and 23 operates without the aid of any biasing spring since upon release of the hand-operated trip portion 16 the elastic force of compressed bellows 19 is sufficient to return the lever mechanism to its original position and to closed discharge tubing 18.

Figure 5:
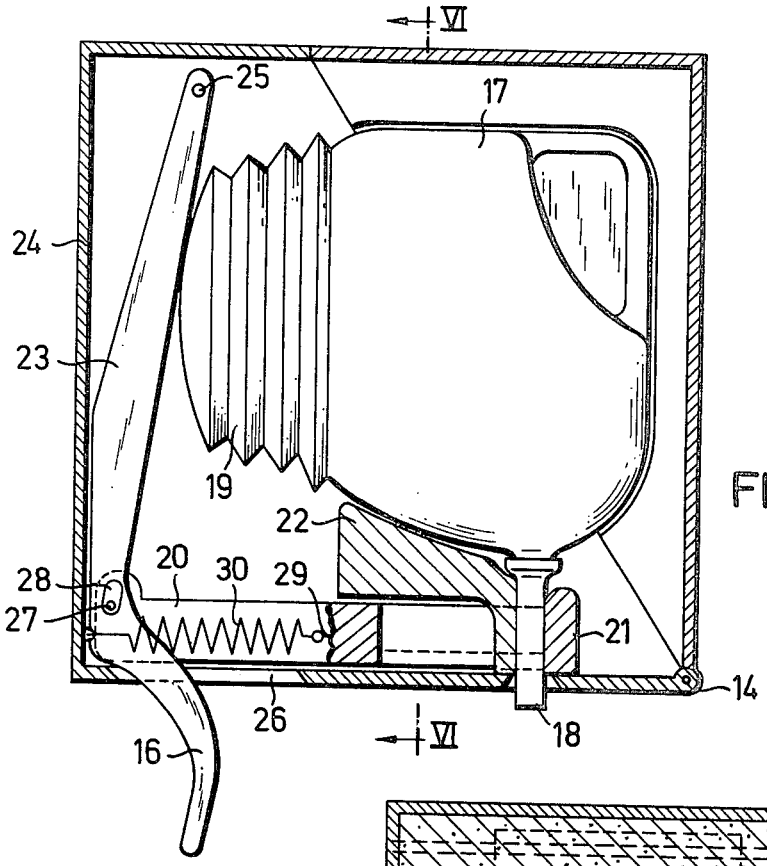
FIG. 5 is a sectional side view of a modification of the dispenser of FIG. 3.
Figure 6:
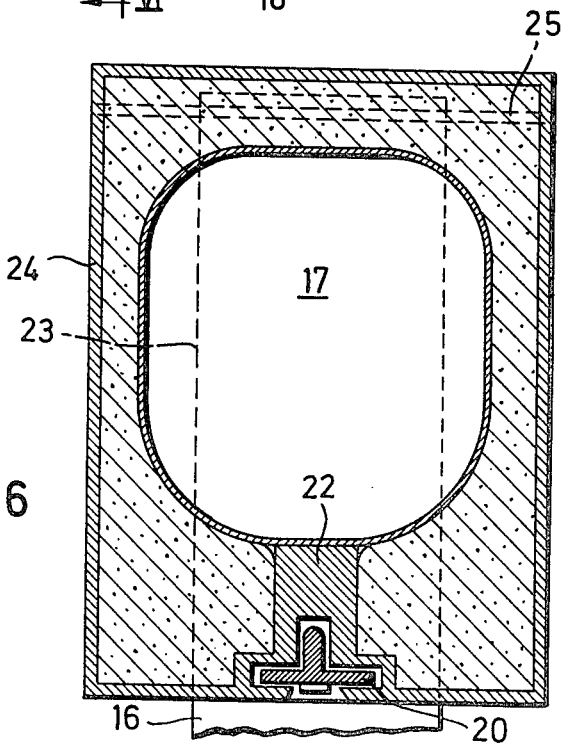
FIG. 6 is a sectional front view of the device of FIG. 5 taken along the line VI—VI.
Figure 7:
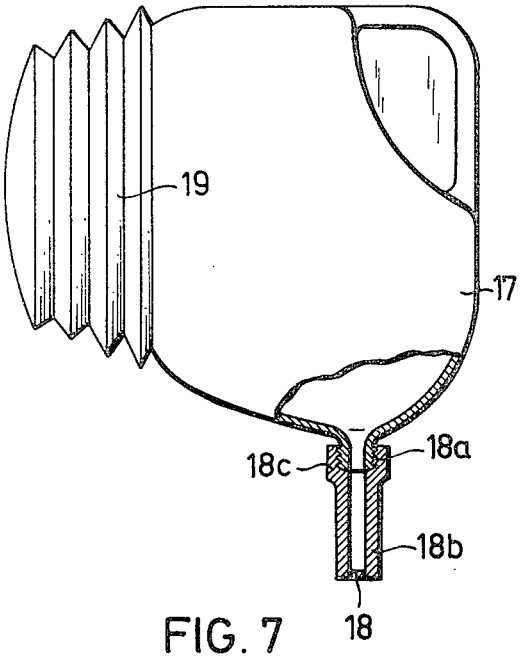
FIG. 7 is a side view, partly in section, of the storage container of the device of FIG. 5.
Figure 8:
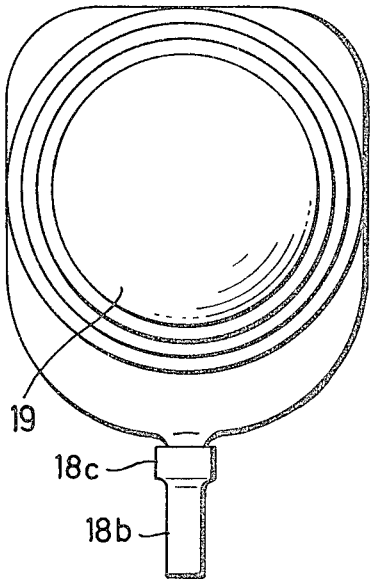
FIG. 8 is a rear view of the container of FIG. 7.
Figure 9:
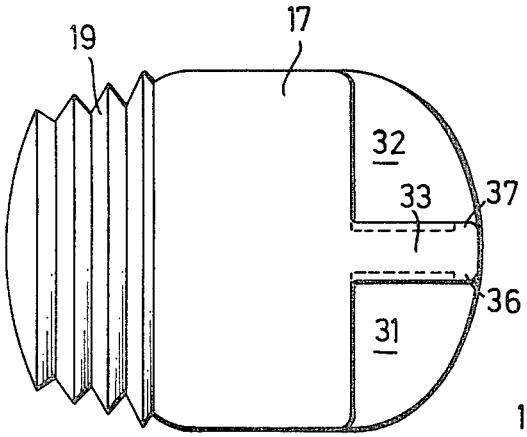
FIG. 9 is a top view of the container of FIG. 7.
Figure 10:
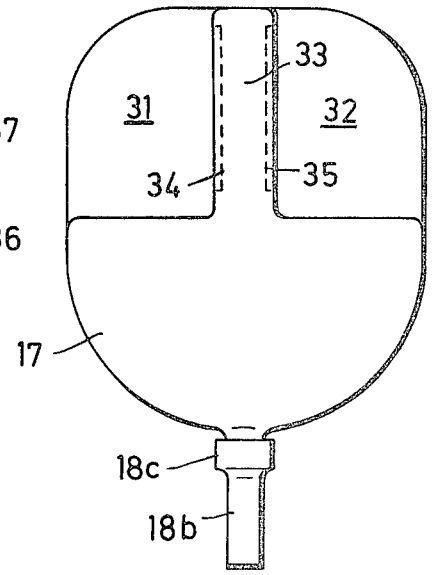
FIG. 10 is a front view of the container of FIG. 7.

A more elaborate embodiment of this invention is shown in FIGS. 5 and 6. In this embodiment, the upper end of upright compressing lever 23 is pivotably mounted at pivot points 25 to housing 11 and projects downwardly through a corresponding rectangular slot 26 in the bottom of housing 11. The downwardly projecting arm integral with upright arm 23 is curved and forms the hand-operated trip lever 16. In this embodiment, slider arm 20 is linked to levers 16 and 23 by means of a pin 27 which is guided in an oblong opening 28 in the bottom range of upright arm 23. To increase the return speed of lever mechanism 16, 20 and 23, a return spiral spring 30 is coupled between the rear wall 24 of housing 11 and the hinge point 29 on sliding arm 20. The pivot point 25 of upright lever 23 is located approximately above the center of guiding slot 26 and the length of oblong opening 28 is dimensioned such as to accommodate the variation of the angular position of lever 23 with respect to sliding arm 20 during the trip of lever 16.

FIGS. 7–10 show the elastic container 17 in greater detail. The container preferably has at its upper front part two lateral depressions 31 and 33 separated by a bridge 33 consisting of two opposite wall portions 34 and 35 spaced slightly apart and extending parallel one to another. This bridge 33 forms a handle for container 17. In order to improve the grip of the handle, the walls 34 and 35 are recessed and form along their edges bulged parts 36 and 37. In other words, the inner part of bridge 33 is undercut relative to its marginal part.

The discharge tubing 18 in this embodiment consists of two parts, namely a coupling nipple or stub 18*a* integral with the walls of container 17 and of resilient tubing 18*b* stretched at one end thereof over the outer surface of stub 18*a*. Preferably, tubing 18*b* is provided with a screw collar ring 18*c* which matches corresponding threads provided on the periphery of coupling stub 18*a*.

Container 17 is made of a soft elastic material preferably of plastic and is filled through discharge stub 18*a*. It will be noted that it is also possible to fill container 17 with a finely granular or pulverized material. The contents are introduced into container 17 via tubing 18*a* with the container 17 upside down, and upon completion of the filling process the filling opening is closed by applying discharge tubing 18*b* which is sealed at its free end (FIG. 7) and serves initially as a closing cap. Depending on the viscosity of the substance in the container, the sealed end of tubing 18*b* can be cut off either prior to the insertion of container 17 in the dispensing housing 11 or as has been described above, after the insertion and after the clamping of tubing 18*b* by the movable projection 21.

Referring again to FIGS. 5 and 6, the inner walls of housing 11, 13 and 15 have a contour corresponding to the outer contour of the non-folded surface of container 17; the inner walls of the housing including the stationary projection 22 are shaped according to the upper surface of the container up to the range of bellows 19. The rear space of housing 11 is sufficient to accommodate bellows 19 together with counteracting upright lever 23. In the embodiment of FIGS. 5 and 6, the inner walls of housing parts 11 and 13 are provided with lining of foam rubber or foam plastic material. This foam lining has sufficient rigidity to prevent displacement of container 17 during the application of pressure by means of upright lever 23 so that the applied pressure is fully transmitted through the liquid contents only.

It will be understood that each of the elements described above, or two or more together, may also find a useful application in other types of constructions differing from the types described above.

While the invention has been illustrated and described as embodied in a dispenser for use with hand-operated lever mechanisms, it is not intended to be limited to the details shown, since various modifications and structural changes may be made without departing in any way from the spirit of the present invention.

What is claimed as new and desired to be protected by Letters Patent is set forth in the appended claims:

1. A dispenser for liquids, pasty substances, powdered substances such as soap and the like, comprising:

a hollow housing;

an integral hollow container with an interior volume, the container being removably securable within the housing and having a resilient compressible and decompressible downwardly extending discharge tube which extends downwardly out of the housing when the container is secured therewithin, and further having a compressible and decompressible bellows formed of a resilient material integral with the container in a manner that the bellows portion may be compressed telescopically to reduce the interior volume of the container and thereby force any substance contained in the container out of the discharge tube; and manually operable means cooperating with the housing, and with the container when the container is secured within the housing, the means simultaneously compressing the bellows and decompressing the delivery tube when in a delivery position, and the means simultaneously decompressing the bellows and compressing the delivery tube when in a closed position.

2. The dispenser defined by claim 1, wherein the bellows includes a plurality of substantially circular folds.

3. The dispenser defined by claim 1, wherein the means includes a movable compressing element which can compress and decompress the bellows and a trip element extending out of the housing, the compressing lever and the trip lever being unitary with each other.

4. In a dispensing device for liquids, pasty substances, and powdered substances, particularly for liquid soap and like toilet articles, a combination comprising:

a housing having an upper end and a lowermost end;

a removable container located within the housing, the container having a downwardly directed tube with a discharge passage and an outwardly projecting frustoconically-shaped bellows which is formed of resilient material and which includes a plurality of substantially circular folds, which plurality at its outermost end terminates in a hemispherical configuration, the bellows being telescopically foldable when compressed and being self-restoring into its initial shape by its own resilient force after the compression is removed, the container further having a region opposed to the bellows, in which region are located two lateral depressions and a bridge portion between the depressions serving as a hand grip;

a lever mechanism including a lever having an upright compressing portion and a trip portion integrally formed therewith, said lever being pivotally mounted in said housing at said upper end thereof so that said compressing portion abuts said outermost end of said bellows, the trip portion projecting from the housing, and a slider adapted to cooperate with said tube and disposed at said lowermost end of said housing, said slider being pivotally connected to said lever between said compressing portion and said trip portion, said trip portion being movable between a closed and a delivery position and adapted to displace said slider for selectively compressing or decompressing said tube and simultaneously urging said compressing portion to decompress or compress the bellows to thereby permit the liquid to be discharged from said tube in said delivery position or to prevent the liquid from flowing out from the tube in said closed position, and biasing means on said slider connected to the housing to urge the slider in a direction to said closed position.

5. A combination as defined in claim 4, wherein said bridge portion consists of two facing walls spaced one from the other and the marginal portions of said walls being interconnected and having a bulging shape to facilitate gripping.

6. In a dispensing device for liquids, pasty substances and powdered substances, particularly for liquid soap and like toilet articles, a combination comprising:

a housing with an interior surface and having a rear part with a lower front edge and a front part, the front part being hinged to the lower front edge of the rear part, and at least the front part of the housing being lined with foam;

a removable container located within the housing and having an outwardly projecting bellows attached thereto, an externally extended downwardly directed coupling stub, a tubing which is open at one end and closed at another end, and having an internally threaded coupling collar, the coupling stub being attached to the container and passing through the housing, the coupling collar being threaded on the coupling stub, the container having an exterior surface conforming with the interior surface of the housing at all regions other than the bellows; and a lever mechanism operatively connected to said bellows and movable between a closed position and a delivery position, said lever mechanism having a slider with clamping means that cooperates with the tubing so that when the lever mechanism is in the closed position the clamping means clamps the tubing and thereby closes it and when the lever mechanism is in its delivery position the clamping means release the tubing.

* * * * *